United States Patent [19]

Oberer

[11] 4,213,278

[45] Jul. 22, 1980

[54] CYLINDRICAL CLAMPING MANDREL FOR A BUFFING OR POLISHING PAD OF SPECIFIC SIZE

[76] Inventor: Walter Oberer, Käferholzstr. 167, CH-8046 Zürich, Switzerland

[21] Appl. No.: 911,946

[22] Filed: Jun. 2, 1978

[30] Foreign Application Priority Data

Jun. 2, 1977 [CH] Switzerland ..... 6829/77

[51] Int. Cl.[2] ..... B24B 5/46

[52] U.S. Cl. ..... 51/368; 51/370

[58] Field of Search ..... 51/262 R, 275, 358, 51/364, 367, 368, 369, 370, 371, 377, 388; 81/3 R

[56] References Cited

U.S. PATENT DOCUMENTS

| | | | |
|---|---|---|---|
| 603,357 | 5/1898 | Bagley | 51/368 |
| 1,326,836 | 12/1919 | Bendix et al. | 51/368 |
| 2,316,545 | 4/1943 | Anderson | 51/368 |
| 2,396,418 | 3/1946 | Grenzow | 51/370 |
| 2,450,617 | 10/1948 | Smith | 51/368 |
| 2,484,335 | 10/1949 | Dingerson | 51/370 |
| 2,489,722 | 11/1949 | Reich | 51/377 |
| 2,553,432 | 5/1951 | Vendien | 51/364 |
| 3,623,280 | 11/1971 | Chesnut | 51/370 |

*Primary Examiner*—Gary L. Smith
*Assistant Examiner*—Robert P. Olszewski
*Attorney, Agent, or Firm*—Brady, O'Boyle & Gates

[57] ABSTRACT

A hollow cylinder having a bore therethrough which is of a larger diameter at one end than at the other end. A longitudinal slot through the cylinder intersecting the smaller diameter bore. A stud in threaded connection with the larger diameter bore and carrying a relatively thin blade-like, clamping mandrel pin with serrated edges that extends into the smaller diameter bore and extends between adjacent folded ends of a polishing cloth disposed around the cylinder with the ends extending through the slot and across the smaller bore, and which functions to rigidly clamp the ends between the serrated edges and the wall of the smaller diameter bore when the stud and clamping mandrel pin are rotated by 90°. A block with a bore for receiving the cylinder with polishing cloth thereon holding the members together during the clamping process and the block includes an angled slot for back-folding the ends of the polishing cloth.

4 Claims, 9 Drawing Figures

A
B
Ac
Ad
Bb
Bc
2
D
Ea
Eb
E
V
Vb
Va
Bd
Aa
Ab
Ba
Be
De
Da

CYLINDRICAL CLAMPING MANDREL FOR A BUFFING OR POLISHING PAD OF SPECIFIC SIZE

BACKGROUND OF THE INVENTION

Field of the Invention

The present invention relates to a cylindrical clamping mandrel for a buffing or polishing pad of specific size. The clamping mandrel is characterized by its especially firm grip on the polishing pad even during axial displacement of the mandrel.

U.S. Pat. No. 603,357 discloses a clamping mandrel which engages in the longitudinal bore on the linen side of the buffing linen. However, when the buffing tool is axially displaced it is very easy to tear the buffing pad from the clamping mandrel.

SUMMARY OF THE INVENTION

The object of the present invention is to ensure that the buffing pad or polishing cloth is gripped firmly on the mandrel in the most reliable and simplest manner.

The problem is solved according to the invention by means of a clamping mandrel consisting of a hollow cylinder comprising a clamping shaft and including a longitudinal slot and bore in which a clamping mandrel pin is rotatably disposed. The bore is continuous and centrally located. Beyond the region of the slot the diameter of the bore is greater than it is in the region of the slot. A stud centrally bearing the clamping mandrel pin which is in the form of a beveled clamping pin equipped with notches on its edges is screwed into the larger diameter bore so that the clamping pin extends into the smaller diameter bore in registration with and adjacent the length of the longitudinal slot.

As a result of these measures according to the invention, the beveled clamping pin is in contact with the sides of the two adjacent folded edges of the polishing pad equipped with the polishing means, when they extend through the slot and across the smaller diameter bore of the hollow cylinder, and when the clamping pin is rotated about 90° the raised edge parts of the clamping pin remaining between the notches of the clamping pin leave deep scratch marks on the side of the pad equipped with the polishing means and which is adjacent the clamping pin in a similar manner to a thread cutting die and the clamping pin wedges the two ends of the pad against the inner surface of the smaller bore. These scratch marks act as a thread and hold the polishing pad firmly in the desired position even when the clamping mandrel is axially stressed so the polishing pad cannot move longitudinally relative to the axis of the hollow cylinder on which it is connected.

As it is difficult to mold the polishing pad or cloth particularly when finish polishing a small bore, it is expedient according to the invention to provide an auxiliary device which is characterized by a prism structure that includes a long bore with a corresponding diameter for receiving the buffing pad and hollow cylinder longitudinally therein to hold the buffing pad firmly and wrinkle free on the hollow cylinder while the buffing pad is clamped on the cylinder by rotation of the clamping pin. The prism also includes a longitudinal slot disposed at an acute angle on a longitudinal edge thereof. The depth of this slot corresponds to the clamping length of the ends of the buffing pad to be folded by inserting the end of a buffing pad in the slot and then folding the pad back upon itself at the edge of the slot.

The drawing shows a cylindrical clamping mandrel according to the invention and the auxiliary tool used to assemble the pad on the mandrel.

DESCRIPTION OF THE PREFERRED EMBODIMENT

The clamping mandrel according to the invention consists of a hollow cylindrical body A with a graduated smaller diameter clamping shaft Ab and a small bore Ac and longitudinal slot Ad on the front end on the buffing tool side corresponding in length to the maximum width of the buffing pad to be used, and a larger bore Aa including screw threads therein, in the clamping shaft. The screw thread of the bore Aa is designed to threadably receive a threaded stud Bc which has a hexagonal or square recess Bd in the end thereof and is rigidly connected to a clamping mandrel pin B. A threaded pin Va of an axially disposed extension member V, with a central bore Vb also is threadably received by the screw thread of the bore Aa, in spaced axial alignment with the stud Bc.

The clamping mandrel pin B is sharply beveled at its front part and comprises in addition to a cutting front end Bb, notches Ba along the narrow sides, substantially throughout its length. Points or lands Be remain between the notches.

Figures 1, 2, 3, 4, 5, 6, 8:
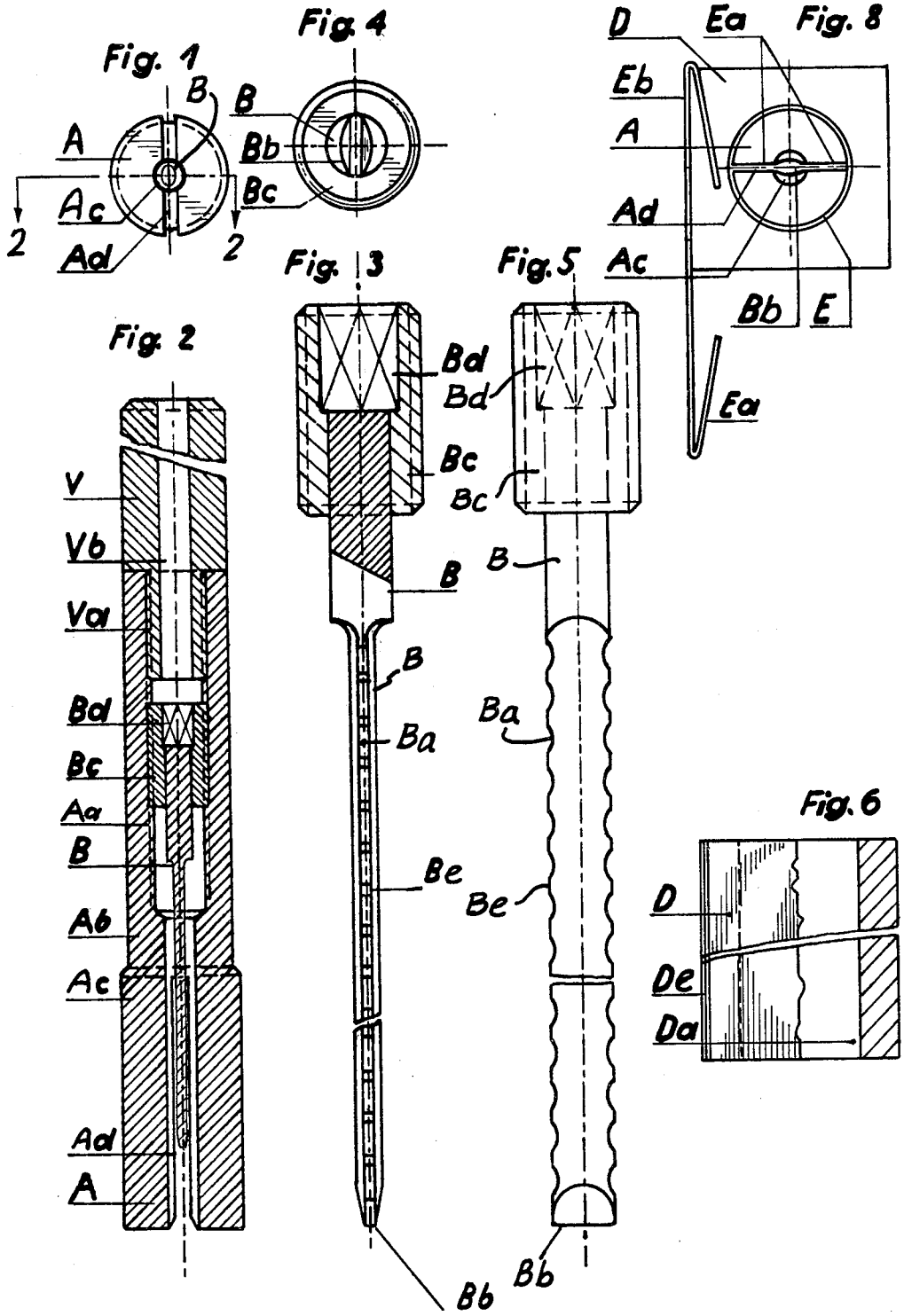
FIG. 1 is an end elevational view of the cylindrical clamping mandrel according to the invention viewed from below.
FIG. 2 is a longitudinal sectional view of the same clamping mandrel taken substantially along line 2—2 of FIG. 1. It is equipped with an extension and the free end of the mandrel pin is shown partly in registration with the longitudinal slot.
FIG. 3 is the clamping mandrel pin viewed from the narrow side and as a partial longitudinal section.
FIG. 4 is an end elevation view of the clamping mandrel pin of FIG. 3 viewed from below.
FIG. 5 is a side view of the clamping mandrel pin of FIG. 3 viewed from the broad side.
FIG. 6 is a side elevation view, partly in section, showing the auxiliary device, a longitudinal sectional view thereof shown on the right and a partial side elevational view thereof on the left and taken substantially along line 6—6 of FIG. 7 but with the mandrel and buffing pad removed for clarity.
FIG. 8 is a top plan view of the auxiliary device but with the clamping mandrel in the position for insertion of a buffing pad, a buffing pad also being shown in the process of being pre-formed or molded on the auxiliary device.
Figure 7:
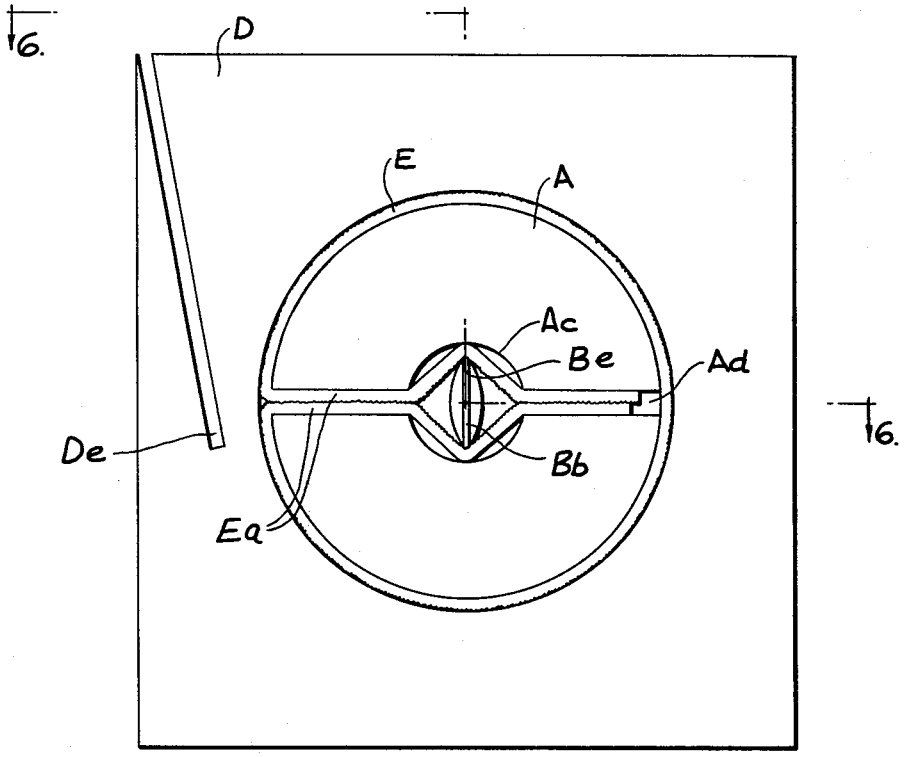
FIG. 7 is an enlarged top plan view of the auxiliary device with the clamping mandrel in the position for use securing a pad on the hollow cylinder.
Figure 9:
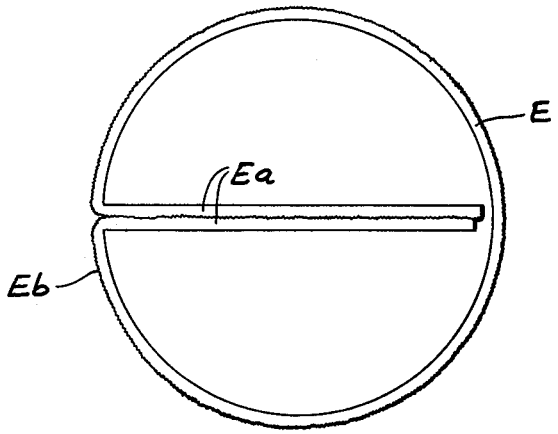
FIG. 9 is an enlarged end elevation view of a preformed buffing pad, ready for insertion in the clamping mandrel according to the invention.

The auxiliary device consists of a prism D including a longitudinal bore Da therethrough for receiving the clamping mandrel hollow cylinder A and the buffing pad E assembled thereon, and including a slot De disposed at an acute angle on a longitudinal edge thereof. The depth of the slot De corresponds to the clamping length of the buffing pad ends Ea, which is approximately the diameter of the hollow cylinder A, which ends Ea are to be folded by placing the ends alternately in the slot and folding the pad back on itself. During the folding operation the granular side Eb of the buffing pad remains outwards after it is formed into a cylinder, FIG. 9, to insure that after insertion of the buffing pad E over the outside of cylindrical body A, with the ends Ea extending through slot Ad, diametrically across bore Ac, in the position shown in FIG. 8, the thin front end Bb of clamping mandrel pin B extends blade-like between the two ends Ea of the pad. Rotation of clamping mandrel pin B in the threaded bore Aa, by use of a tool inserted in the recess Bd, from the position shown in FIG. 8 into the position shown in FIG. 7, approximately 90°, causes the points Be disposed between the clamping mandrel notches Ba to penetrate deeply into the granular layer on side Eb of the ends Ea of the buffing pad in the manner of a thread cutting die and thus firmly secure the buffing pad E in the desired position wedged between the points Be and the surface of the small diameter bore Ac even when buffing in an axial direction. The pad ends are thus firmly wedged between the points Be and the inner wall of bore Ac, and the bore Da of prism D holds the pad E in position on the body A during the clamping process after which body A with the pad secured thereon is withdrawn from the auxiliary device.

The terms and expressions which have been employed herein are used as terms of description and not of limitation, and there is no intention, in the use of such terms and expressions, of excluding any equivalents of the features shown and described or portions thereof but it is recognized that various modifications are possible within the scope of the invention claimed.

What is claimed is:

1. A cylindrical buffing or polishing mandrel comprising; a hollow cylinder (A) having a clamping shaft portion (Ab), a continuous bore (Aa,Ac) therethrough that is centrally located, and a longitudinal slot (Ad) in communication with said bore (Ac) and extending diametrically of said hollow cylinder; said bore having a greater diameter portion (Aa) in the region beyond said longitudinal slot; a clamping mandrel rotatably disposed in said bore and including a stud portion (Bc) rotatably connected in the greater diameter portion (Aa) of said continuous bore, and a thin clamping pin portion (B) having a width greater than the thickness thereof extending forwardly from said stud portion in said bore (Ac) adjacent said longitudinal slot (Ad) substantially throughout the length thereof, the width of said clamping pin portion being slightly less than the diameter of said bore (Ac) adjacent said longitudinal slot; a polishing pad (E) extending around said hollow cylinder (A) and having opposite ends (Ea) extending inwardly across substantially the entire diametrical length of said longitudinal slot (Ad) and the polishing surfaces thereof positioned on opposite sides of said clamping pin portion; and said clamping pin portion having beveled knife-like edges forming knife-like gripping points (Be) along the opposite longitudinal edges thereof adapted to penetrate the polishing surfaces of said opposite ends (Ea) substantially along a plane through the axis of said bore (Ac) and at right angles to said longitudinal slot (Ad) to clamp the ends (Ea) of said polishing pad against the surface of said bore (Ac) when said clamping mandrel is rotated in said bore.

2. A cylindrical buffing or polishing mandrel as set forth in claim 1, in which said clamping pin portion has a free end (Bb) inwardly of the outer end of the longitudinal slot.

3. A cylindrical buffing or polishing mandrel as set forth in claim 1, in which said clamping pin portion has a beveled free end (Bb).

4. A cylindrical buffing or polishing mandrel as set forth in claim 1, in which said clamping mandrel is adapted to be rotated approximately 90° to clamp the ends (Ea) of said polishing pad on said hollow cylinder.

* * * * *